United States Patent [19]

Alvarez

[11] Patent Number: 4,691,686

[45] Date of Patent: Sep. 8, 1987

[54] GASEOUS FLOW CONTROL FOR COMBUSTION DEVICES

[76] Inventor: Bernard V. Alvarez, Rt. 1, Box 249, Candler, N.C. 28715

[21] Appl. No.: 785,151

[22] Filed: Oct. 7, 1985

[51] Int. Cl.[4] ..... F24C 1/14

[52] U.S. Cl. ..... 126/77; 126/117; 126/288; 126/289; 126/112; 110/203

[58] Field of Search ..... 126/77, 112, 72, 80, 126/67, 288, 289; 236/92 C, 11, 94, 45; 110/203

[56] References Cited

U.S. PATENT DOCUMENTS

| | | | |
|---|---|---|---|
| 4,180,051 | 12/1979 | Maier et al. | 126/77 |
| 4,267,818 | 5/1981 | Taylor | 126/288 X |
| 4,345,897 | 8/1982 | Stanton | 126/117 X |
| 4,471,755 | 9/1984 | Faehling et al. | 126/112 X |
| 4,476,852 | 10/1984 | Lee et al. | 126/289 |
| 4,530,346 | 7/1985 | Roy | 126/77 |

*Primary Examiner*—Larry Jones
*Attorney, Agent, or Firm*—Dority & Manning

[57] ABSTRACT

An intake air pathway for a wood-burning stove is provided with a control mechanism which automatically responds both to changes in temperatures for controlling the amount of intake air flowing in the pathway and to pressure due to back puff conditions in the stove for closing the intake pathway with and thereby preventing emissions due to back puff. The point of control of the intake pathway may be placed along different points of the pathway. Control valve and check valve functions may be accomplished with a single control surface (i.e., plate or flap), or alternatively, be segregated into two control surfaces. The control arrangement is disposed such that gravity always acts as a safety feature to close the intake air pathway during an uncontrolled fire (e.g. chimney fire) or physical failure of the control apparatus. A fixed-shield baffle system surrounding a combustor of the stove causes reversals of combustion gasses and a secondary air flow supplied to the combustor. Such reversals generate a swirling action of the combustion gasses and secondary air flow which in turn causes a balanced flow of the same across the entire surface of the combustor. This enhances the eveness of combustor activity, thereby improving both efficiency of combustor operation and longevity of a given combustor.

26 Claims, 13 Drawing Figures

GASEOUS FLOW CONTROL FOR COMBUSTION DEVICES

BACKGROUND OF THE INVENTION

This invention is generally concerned with gaseous flow control in and around an apparatus which provides heat through controlled combustion. More specifically, it concerns automatic and thermally-responsive control valves and check valves for gaseous passages in a wood-burning stove. Additional features concern a fixed-shield baffle system around a combustor of a wood-burning stove. The baffle system generally provides a more balanced flow of a mixture of combustion gasses and fresh air across the surface of the combustor.

In general, conventional wood-burning stoves have various openings and/or passageways which permit fresh air to flow from outside of the stove into an interior firebox. Also, it is known to provide a flow of combustion gas materials through a combustor operative with a wood-burning stove. Such a combustor may be associated with a heat exchanger having its own flow of air and having heat dissipation fins disposed therein. It is generally known to control both the flow of air into the firebox ("primary" air flow) and the flow of ("secondary" air flow) and combustion gasses to the combustor so as to respectively control both the firebox combustion operation and combustion function of a conventional wood-burning stove.

During desired operation of a conventional wood-burning stove, smoke and other gaseous by-products of combustion are exhausted up through a flue and out a chimney. It is generally known that, due to pressure changes or other unintended flows of air, some smoke or gaseous combustion by-products may back up in the firebox and be exhaused into a room through an intake air passage. Such a highly undesirable and potentially dangerous event is commonly referred to as "back puff."

One of ordinary skill in the art understands that controlling the amount of intake air into a stove influences the level of combustion activity within the stove. Accordingly, it is generally known to automatically control intake air paths with thermally-responsive control valves. Such conventional control valves have the goal of automatically controlling the stove combustion operation. However, such control valves in general do not readily accomodate other features in a single, integral device. For example, in general a single conventional control valve does not also provide protection against the problem of back puffing, discussed above.

Further, conventional wood-burning stoves may be equipped with a combustor element, which is typically a solid cylinder comprised of porous material. Gaseous materials from the firebox of a stove are passed through and around the combustor so as to fuel its operation. If the flow of combustion gasses in and around the combustor is not properly controlled so as to be relatively uniform in nature, the combustor element itself functions in an uneven pattern of varying temperatures.

Such operation causes problems in that the combustor may be physically damaged and its life significantly shortened by uneven operation. For example, if one peripheral area of the combustor is substantially hotter than remaining portions, the expansion of the hotter area will act as a wedge to split the combustor diagonally across its diameter. Alternatively, if the flow of combustion gasses in and around the combustor is such that the centermost portion of the combustor is hotter than the surrounding portions, the center will be crushed by its cooler and harder surroundings as it attempts to expand. When this occurs, the center of the combustor will simply become separated from the remainder of the combustor and fall out of the combustor. In either instance, the combustor must be replaced, which can be both expensive and time consuming.

SUMMARY OF THE INVENTION

In general, the present invention discloses improved flow control of gasses in and around a conventional stove as a solution to many of the above-noted problems.

The present invention includes temperature-responsive control of intake air flow and also features automatic response to occurrences of back puff for closing intake air paths. Such operation prevents the actual emission of back puff gasses into a room.

Furthermore, the present invention discloses a fixed-shield baffle system to control the flow of combustion gasses from a firebox and fresh air from the intake air path around a combustor so as to cause a mixing, swirling action of the same. Such flow control fully disperses the mixture of combustion gasses and secondary air flow over and around the combustor so that a balanced flow of the mixture generally covers the entire surface of the combustor. Also, a relief valve responsive to a preset amount of pressure is disposed directly between the firebox and the flue to prevent an excessive build-up of pressure in the firebox.

Accordingly, it is one object of the present invention to provide an improved intake air flow control valve, and further to provide an improved air flow control valve which both controllably varies the amount of primary intake air being admitted to the firebox and protects against emissions caused by back puff.

It is another object of the present invention to provide a thermally-responsive control valve which automatically varies based on ambient temperature the amount of air permitted to enter a firebox, while simultaneously and automatically responding to an occurrence of back puff to seal off or reduce gaseous flow in the intake pathway and thereby prevent escape of gaseous combustion by-products into a room.

It is a further object of this invention to provide a device for controlling intake air flow and preventing back puff emissions with as little as a single flap disposed in an intake air pathway. Use of a single control surface simplifies automatic temperature-based control of intake air and automatic response to back puff.

Another object of each embodiment of this invention concerns a safety shutdown feature. If there is a physical failure of the control elements of the invention, an element of the control apparatus is configured to respond to such failure to close off or restrict the intake air flow solely by the force of gravity. Such a safety feature may also be operative during an uncontrolled burn, such as a flue or chimney fire.

Still another object of the present invention concerns improved flow of gasses in and around a combustor for achieving a more balanced flow of gasses and secondary air across the entire surface of the combustor. More generally, it is an object of this invention to prolong the useful life of combustors by preventing or minimizing physical harm thereto otherwise caused by their uneven operation. It is also an object of this invention to enable use of "lower-grade" combustors without degradation of the overall performance of a wood stove. It is yet another object of the present invention to generally obtain a balanced flow of combustion gasses, augmented with a secondary flow of fresh air as well, across the entire surface of combustors in wood-burning stoves.

The foregoing list of objects and features of the present invention is intended as exemplary only. Furthermore, the foregoing list is not to be considered as all inclusive, but as only a brief summary of the advantages which may be obtained with practice of the present invention, as further disclosed and discussed hereinbelow.

BRIEF DESCRIPTION OF THE DRAWINGS

The present invention may be better understood by studying the following detailed description, accompanied by the appended figures, in which.

Figure 1:
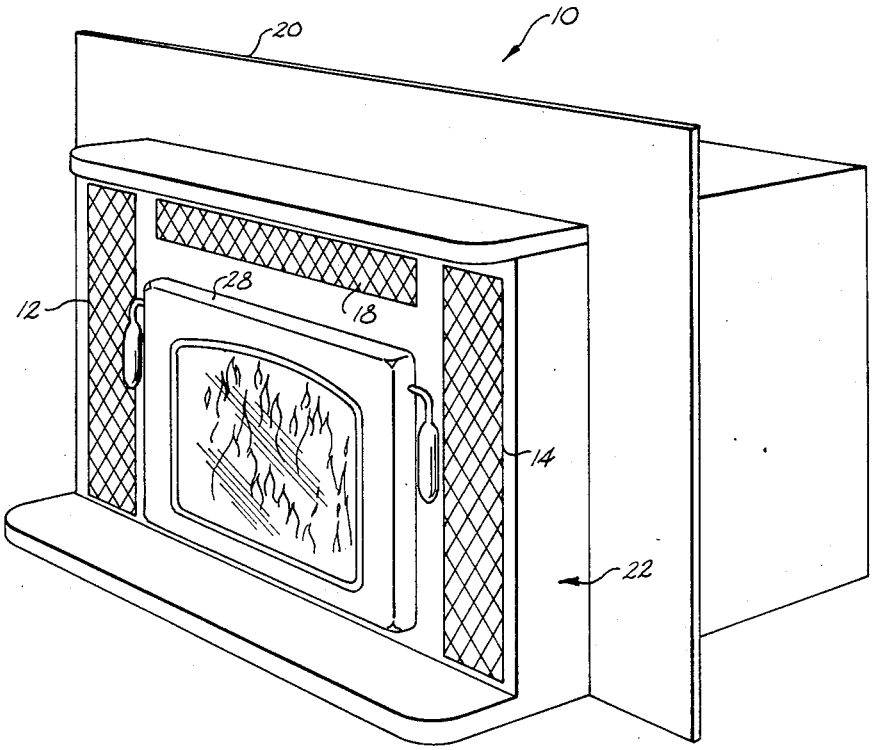
FIG. 1 is an exterior perspective of a wood-burning stove which is suitable for use with the present invention.

Multiple uses of a given reference character in any of FIGS. 1–13 is intended to connote similar or analagous elements in the various figures, without necessarily requiring separate discussion thereof.

DETAILED DESCRIPTION OF THE PREFERRED EMBODIMENTS

FIG. 1 illustrates an exterior perspective view of a wood-burning stove 10 having a pair of side screens 12 and 14. Such screens along their length may cover various intake air openings. Grillwork 16 may typically be associated with an output flow of air which has been heated by operation of a heat exchanger portion of wood-burning stove 10. Front door 18 of wood-burning stove 10 is hinged at its bottom, and may be downwardly pivoted by such hinge to permit access to a firebox chamber located within stove 10. Flange 20 is made sufficiently large to prevent any casual flow of air from entering a fireplace in which stove 10 resides. Accordingly, only gasses which are exhausted through a flue in the top of stove 10 (illustrated in later figures) pass upward through the chimney of the fireplace.

Alternatively to openings behind screens 12 and 14, side wall 22 of stove 10 may form one wall of interior vertical channels which extend from some point near the bottom of the stove to some point near the top of the stove. Side wall 22 may have openings to permit fresh air from outside of stove 10 to enter such interior channels. Then, openings provided in the top of the channels may permit the fresh air having entered the channels to subsequently enter the firebox of stove 10. Such channels and openings may be variously used in accordance with the present invention, and are more fully illustrated in subsequent figures.

Figure 2:
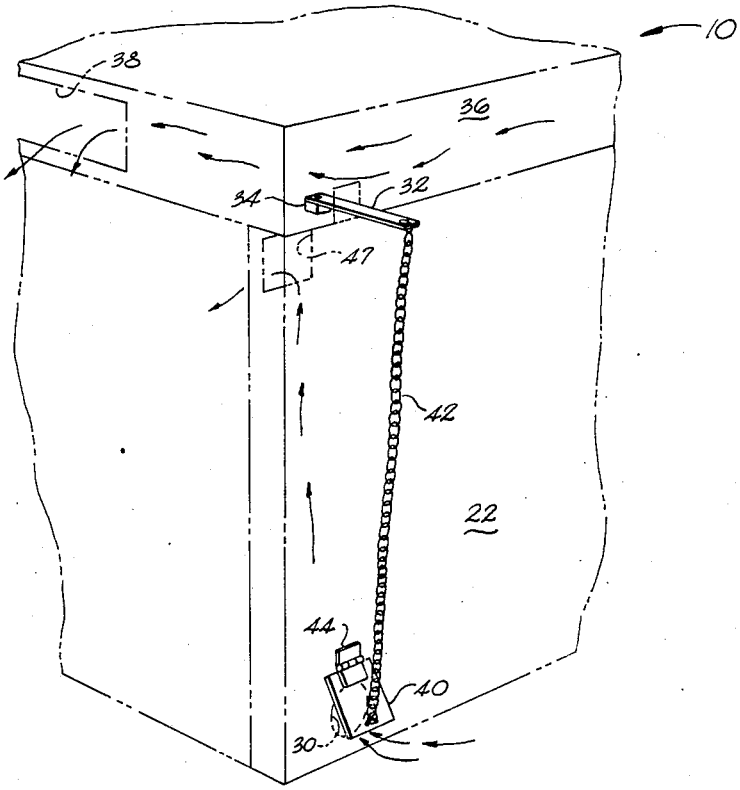
Fig. 2 (PRIOR ART)
FIG. 2 illustrates an exemplary prior art temperature-responsive control valve for use with an intake air flow.

Referring now to FIG. 2, opening 30 represents a typical prior art opening in a side wall 22 of stove 10. In general, it is known to mount a thermally-responsive element such as bi-metal element 32 in a cantilevered fashion such as at point 34. Such a fixed mounting of element 32 permits it to be responsive to the temperature of air which flows in an interior chamber 36 around to the front of stove 10 and out an opening 38, which opening may be provided behind grillwork 16 of FIG. 1. As illustrated in FIG. 2 by chain 42, temperature-responsive movement of bi-metallic element 32 has a direct, fixed relationship with flap 40, which hingedly covers opening 30.

As shown by the arrows entering opening 30, fresh, outside air enters opening 30 and subsequently flows up interior vertical channel 45 and through opening 47 into the firebox within stove 10. Bi-metallic element 32 generally is biased so as to raise flap 40 with decreasing temperature and lower flap 40 with increasing temperature. The actual physical displacement of element 32 determines the degree of opening of flap 40. In such manner, the flow of fresh air (which of course includes oxygen for combustion) to the firebox of stove 10 is automatically controlled in general accordance with a temperature sensed within chamber 36.

Flap 40 is pivotally mounted with hinge 44 such that the force of gravity will cause flap 40 to close should there be any failure in chain 42. All embodiments of this invention also include this important safety feature, as discussed further below. However, if there is back puff within stove 10, nothing illustrated in the general prior art device of FIG. 2 would prevent flap 40 from being pushed outward by the pressure of such back puff. Thus, combustion fumes from stove 10 would be undesirably released into a room occupied by stove 10 due to back puff.

Figure 3:
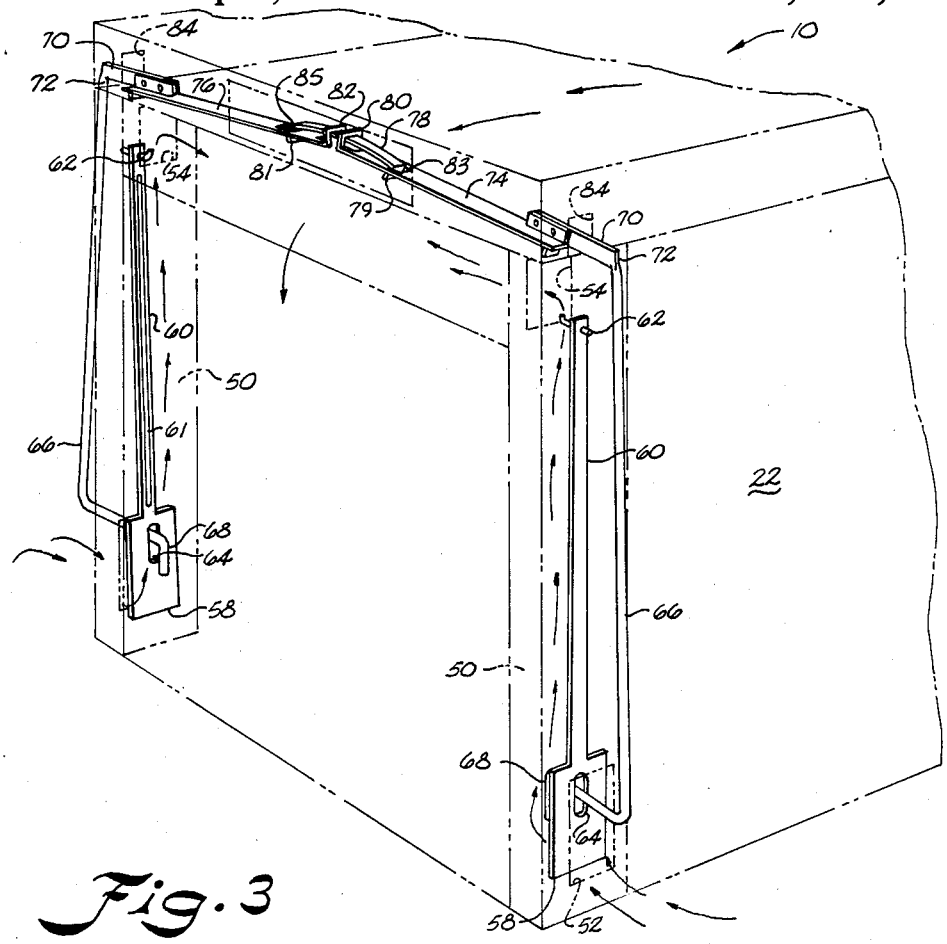
FIG. 3 illustrates one embodiment in accordance with this invention of a combination primary intake air flow control valve and back puff protection check valve, which embodiment also features a gravity-operated safety element for preventing intake air flow during a chimney fire or control element failure.

FIG. 3 illustrates a control valve system, which generally exemplifies a first embodiment in accordance with the present invention, for providing both a control function for the amount of air taken into the firebox and a check function for prevention of emissions due to back puff. Stove 10 has an interior columnar chamber 50 oriented vertically just behind side wall 22. Close to the bottom of chamber 50 is an opening 52 in side wall 22 which permits fresh outside air to enter chamber 50. Adjacent the top of columnar chamber 50 is an opening 54 which permits fresh outside air in chamber 50 to enter the interior firebox of stove 10. Arrows illustrated in FIG. 3 show the flow of air from outside stove 10 into chamber 50 through opening 52, and exiting chamber 50 through opening 54. The long arrow 56 of FIG. 3 illustrates the downward motion of fresh air originally from outside stove 10 into the interior firebox of stove 10.

To function as a check valve for the prevention of emisions due to back puff, pendulum head 58 hangs adjacent opening 52 slightly biased theretowards and is integral with pendulum arm 60, which is freely mounted on stem 62. Slightly raised ribs 61 on the interior sides of arms 60 are sufficient to cause pendulum heads 58 to be slightly biased towards openings 52. Stem 62 is secured to the interior side of side wall 22 of stove 10. Back puff occuring in stove 10 causes a reverse flow of air in chamber 50 (i.e., downward), which attempts to exit through opening 52. Pendulum arm 60 under pressure from such back puff is free to move from its illustrated position towards opening 52. Sufficient back puff pressure effectively holds pendulum head 58 against opening 52. Head 58 is larger than opening 52. Therefore, combustion gasses are substantially sealed from exiting opening 52. Opening 64 in pendulum head 58 may permit some minor amount of back puff gasses to exit opening 52; however, in general, the significant major portions of back puff gasses are prevented from being exhaused into a room.

An end portion of a generally L-shaped member 66 passes through opening 64 of pendulum head 58. L-shaped member 66 has a finger end-piece 68 which may hook pendulum face 58 so as to draw pendulum face 58 closer towards opening 52. At its top, L-shaped member 66 has a shoulder piece 70 which has a fixed elbow joint 72. A pair of control members 74 and 76 are arranged so as to support and be raised by a bi-metallic element 78. The masses of control members 74 and 76 are disposed so as to pivot downward under the force of gravity in the absence of uplifting force from bi-metallic element 78.

Bi-metallic element 78 is a curved piece of two metals which is partially held in place on control elements 74 and 76 by end portions thereof 80 and 82, respectively. Bi-metallic element 78 is further held in place by its end members 79 and 81 which are turned downward at about ninety degree angles. End members 79 and 81 project downward through openings 83 and 85 formed in control members 74 and 76, respectively. This structure is shown in greater detail in FIGS. 4 and 5. The downturned portions are sufficient in length to keep ends 79 and 81 entrained in openings 83 and 85 during most temperature-responsive flexing of bi-metallic element 78.

Bi-metallic element 78 is formed such that it provides a flexing motion in response to changing temperatures. Such motion in an upward direction in turn causes control elements 74 and 76, which are fixedly secured to shoulder pieces 70, to rotate L-shaped members 66 about axis points formed by the bottom of openings 84. Downward flexing of element 78 permits the force of gravity to act on masses 74 and 76 and bring them down. Automatic temperature control is desired such that the amount of air entering interior chamber 50 through opening 52 is reduced as the ambient temperature sensed by bi-metallic element 78 increases. Thus, in response to warmer temperatures, bi-metallic element 78 flexes downward to permit L-shaped members 66 to be pivoted by masses 74 and 76 outward towards opening 52. Conversely, as colder air flows over bi-metallic element 78, it is desirable to increase the combustion activity within the firebox of 10 by increasing the flow of air thereto. To accomplish such operation, bi-metallic element 78 flexes in response to cooler temperatures so as to raise respective control members (masses) 74 and 76, and thereby cause L-shaped members 66 to move away from openings 52. As clearly illustrated by FIG. 3, a set of pendulum arms 60 and L-shaped members 66 are operative with a pair of openings 52, one on each side of stove 10, responsive to control members 74 and 76.

Movement of L-shaped members 66 in this latter direction is only permissive as to additional air flow into interior chamber 50, while movement in the direction of opening 52 positively causes the respective pair of pendulum heads 58 to seal openings 52, or reduce the amount of air flowing into chamber 50. Such function permits pendulum heads 58 to be simultaneously used as a control surface for the amount of air entering interior chamber 50 and a protective surface (check valve) to prevent the occurrence of emissions due to back puff, as discussed above. In other words, the illustrated arrangement of an L-shaped member 66 through opening 64 and pendulum head 58 can be utilized so that finger-end piece 68 can be positively moved so as to seal opening 52 as required, while its movement in the opposite direction merely enables pendulum head 58 to move away from opening 52 and yet still be subject to closure by pressure from back puff.

Figure 4:
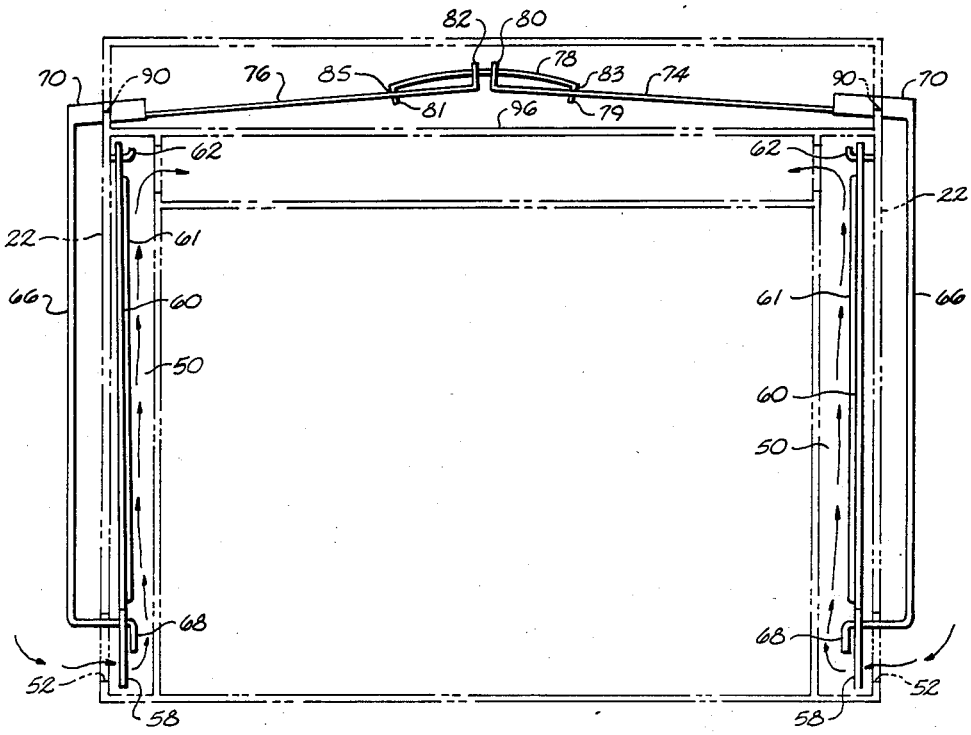
FIG. 4 is a frontal perspective of the combination control valve and back puff protection check valve embodiment of FIG. 3.

Referring now to FIG. 4, a frontal view of the flow control apparatus of the FIG. 3 embodiment is illustrated. This figure more clearly illustrates the paired nature of the control elements 74 and 76, L-shaped members 66, pendulum arms 60 with raised biasing ribs 61, and interior chambers 50. Shoulder members 70 each have notched portions 90 which engage the bottom of openings 84 in side-walls 22 so as to form a pivot point for the L-shaped member 66 at the point of engagement. Curved bi-metallic element 78 rests in a cradle formed by the control elements 74 and 76. The top of buckle elements 80 and 82 restrict the position of element 78 in the vertical direction. Downward end members 79 and 81 of element 78 respectively engage opening 83 in control member 74 and opening 85 in control member 76 so as to restrict movement of element 78 in its horizontal direction. Wall 96 is an upper surface within stove 10 which faces the temperature-responsive elements 74, 76 and 78. These features are more clearly shown in the enlarged illustrations of FIG. 5.

As further illustrated by FIG. 4, pendulum elements 60 are free to move in the direction of openings 52 as necessary to prevent the escape of combustion gasses into a room by an occurrence of back puff. Also, ribs 61 cause arms 60 to pivot about stems 62 so as to slightly bias pendulum heads 58 towards openings 52. As discussed above, flexure of bi-metallic element 78 in response to temperature changes of its surrounding air causes control members 74 and 76 to be moved upward or permits them to be moved downward in tandem in a generally vertical direction. In this manner, control elements 74 and 76 serve as long lever arms operating about a fulcrum existing at engagement points 90 for moving L-shaped members 66 controllably in or away from the outer side walls 22 of stove 10.

As cooler air passes over element 78, the bi-metallic element flexes so as to raise end members 80 and 82 of control members 74 and 76, respectively. This in turn causes the L-shaped members 66 to move inward toward respective side walls 22. While this action does not force the pendulum heads 58 to move further away from openings 52, it does permit such movement in the absence of back puff conditions and if sufficient chimney draft/draw is present to overcome the slight biasing by ribs 61. Any such biasing is sufficiently slight, however, so as to be readily overcome by chimney draft/-draw, thereby permitting the illustrated assembly to use pendulum heads 58 as both control valves and check valves in an intake air flow system for a wood-burning stove.

Figure 5:
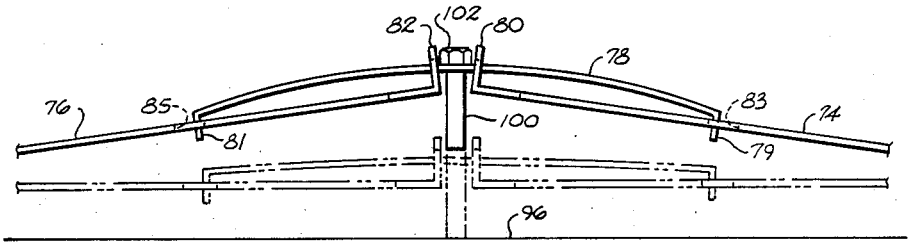
FIG. 5 is a frontal view of a temperature responsive element of the combustion control and check valve embodiment of FIGS. 3 and 4.

Referring now to FIG. 5, bi-metallic element 78 is illustrated in two different positions with respect to partial representations of control elements 74 and 76. End elements 80 and 82 by friction hold bi-metallic element 78 in place in the vertical direction. Downward ends 79 and 81 cooperate with openings 83 and 85, respectively, of control members 74 and 76 to hold bi-metallic element 78 in place in its horizontal direction. There are no further attachments necessary between bi-metallic element 78 and control elements 74 and 76, other than the frictional forces inherent in the above-noted positioning elements which are integrally formed with the structure of control elements 74 and 76.

Referring now to the two representations of the temperature-responsive mechanism, the "upper" representation (i.e., the labeled representation of FIG. 5) illustrates a relatively cool air condition, while the "lower" representation of the same (i.e., the unlabeled representation of FIG. 5) illustrates what occurs in a relatively warm air condition. Bi-metallic element 78 is arranged for safety reasons such that warmer air conditions or mechanical failure of element 78 permit gravity to cause the masses of control elements 74 and 76 to fall downward towards an upper surface 96 of the firebox portion of stove 10, and thereby close openings 52. A central support bolt 100 secured to bi-metallic element 78 by head 102 may be used to establish the proper initial position of elements 74 through 78 whenever they are installed for the first time in stove 10. Also, head 102 serves as a check element against end elements 80 and 82 so as to further limit the horizontal movement of bi-metallic element 78. In other words, bi-metallic element 78 can not slip out of end elements 80 and 82 because head 102 does not permit element 78 to move beyond relatively minor tolerances, as illustrated.

Considering FIG. 5 in conjunction with FIG. 4, it is more clearly seen that control arms 74 and 76 are masses comprising relatively long lever arms which are operated on at their end elements 80 and 82 by flexure of bi-metallic element 78 and by gravity. Generally, as bi-metallic element 78 encounters warmer air, the element flattens out to permit downward movement of end elements 80 and 82 under force of gravity acting on masses 74 and 76, which in turn cause L-shaped arm members 66 to move outward respectively from side walls 22 of stove 10. Finger end elements 68 grab pendulum heads 58 and pull them outward towards openings 52. As earlier discussed, pendulum heads 58 are larger than openings 52, and therefore substantially close off or reduce the flow of intake air into the firebox (or emissions due to back puff), which is the desired control function whenever warmer temperatures are sensed.

Conversely, as cooler temperatures are sensed with bi-metallic element 78, the element flexes more in a curved fashion so as to draw end elements 80 and 82 upwardly. This relatively upward movement overcomes gravity acting on masses 74 and 76 to cause the long levers formed by control elements 74 and 76 to pivot L-shaped arms 66 about the fulcrums formed by engagement points 90 in an inward direction towards side walls 22 of stove 10. Finger end elements 68 are therefore moved away from openings 52 so as to permit pendulum heads 58 to also move in that direction. As discussed above, this control action does not force the pendulum heads 58 away from openings 52 necessarily. Pendulum heads 58 also serve a function as a check valve against back puff, as discussed above, and therefore are always free to respond to back puff conditions and move closer towards opening 52 so as to effectively eliminate disadvantageous discharge of combustion byproducts.

Figure 6:
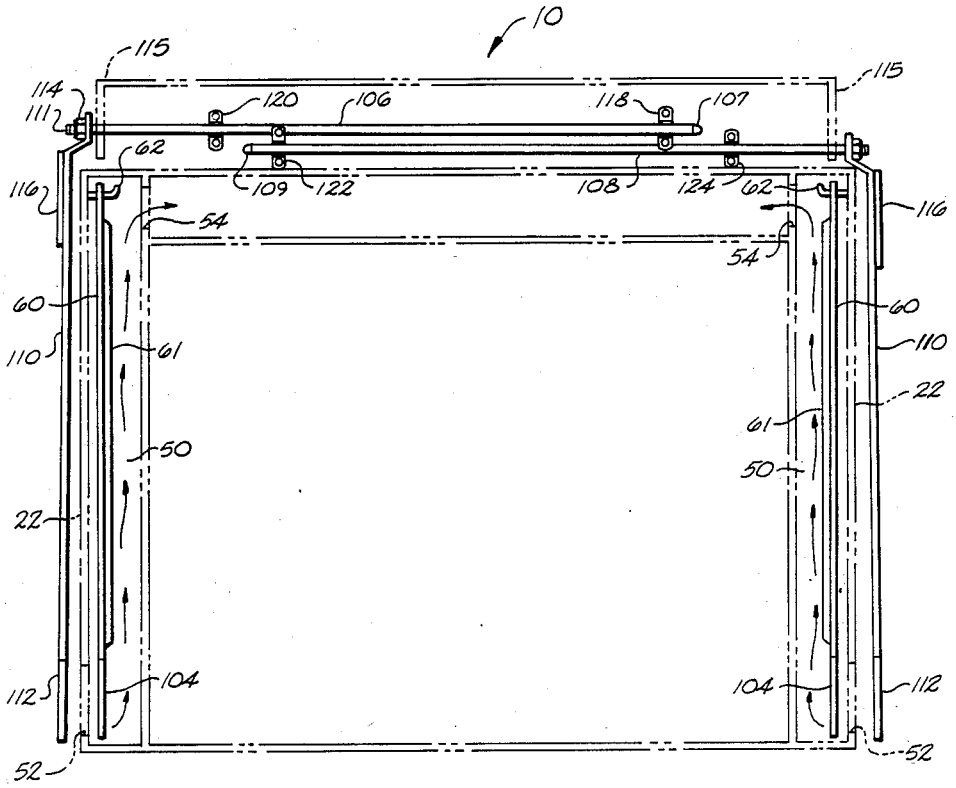
FIG. 6 is an alternative embodiment of a combined control and back puff protection check valve in accordance with this invention.

Referring now to FIG. 6, an alternative embodiment of the pendulum control and check valve system of FIGS. 3–5 is illustrated. Again, stove 10 has a pair of interior intake air flow chambers 50, with lower openings 52 open to exterior air and upper openings 54 leading to the firebox of stove 10. Pendulum arms 60 hang freely from elements 62, and have raised ribs 61 for slightly biasing heads 104 towards openings 52, as in previous embodiments. Pendulum arms 60 have pendulum heads 104 which differ from pendulum heads 58 of the earlier embodiment in that they have no openings 64 in their face for the reception of extended portions of L-shaped arms 66. Therefore, pendulum arms 60 with pendulum heads 104 perform only check valve functions with regard to opening 52. In other words, back puff conditions occurring in intake air chamber 50 will push the pendulum heads 104 outwards towards side walls 22 so as to seal or partially close openings 52, without regard to any control by temperature-reponsive mechanisms. Without back puff conditions, normal chimney draft/draw may be sufficient to overcome the slight biasing of heads 104 and open same.

The control valve portion of the FIG. 6 embodiment is actuated by a parallel pair of bi-metallic rods 106 and 108. Rods 106 and 108 are housed generally in the same location of stove 10 as that occupied by the temperature-responsive control elements of the FIG. 3 embodiment. However, L-shaped arms 66 are replaced with straight hanging members 110 which have their own respective flat end plates 112, which are larger than opening 52. Nuts 114 thread onto the interior metal portions 111 and 113 of rods 106 and 108, respectively. Rods 106 and 108 are crimped at points 107 and 109, respectively. This crimping in conjunction with the outside sheathing of rods 106 and 108 terminating against fixed wall surfaces 115 permits parallel rods 106 and 108 to function as long lever arms formed to control movement of hanging arms 110. The balanced action of this temperature-responsive control arrangement is assisted by the integral addition of ballast plates 116 to each of the hanging arms 110.

Bi-metallic rod 106 is slidably supported by elements 118 and 120. Varying temperatures around rod 106 causes the rod to expand or contract along its length, thereby pivoting arm 110 about pivot points at nuts 114. Such pivoting movement causes end plates 112 to move away from or towards opening 52. In a similar fashion, rod 108 is slidably supported by elements 122 and 124. Rod 108 is also varied along its length by the relative differential contraction and expansion of the bi-metallic elements contained therein.

The embodiment of FIG. 6 has both control valve and check valve features, in common with other embodiments. Pendulum arm 60 of either the FIG. 3 or FIG. 6 embodiment is always free to respond to back puff pressure by moving towards opening 52 so as to controllably seal the same. Similarly, L-shaped arms 66 and hanging arms 110 are always free to be controlled by their respective temperature-responsive control elements so as to vary the amount of air entering the intake air flow columnar chamber 50. Of course, in either embodiment, the protection against back puff emissions of the respective check valve arrangements can always override the control valve features so as to limit the flow of intake air regardless of the condition of bi-metallic element 78 and its related elements, and thereby simultaneously limit or eliminate emissions resulting from back puff.

Figure 7:
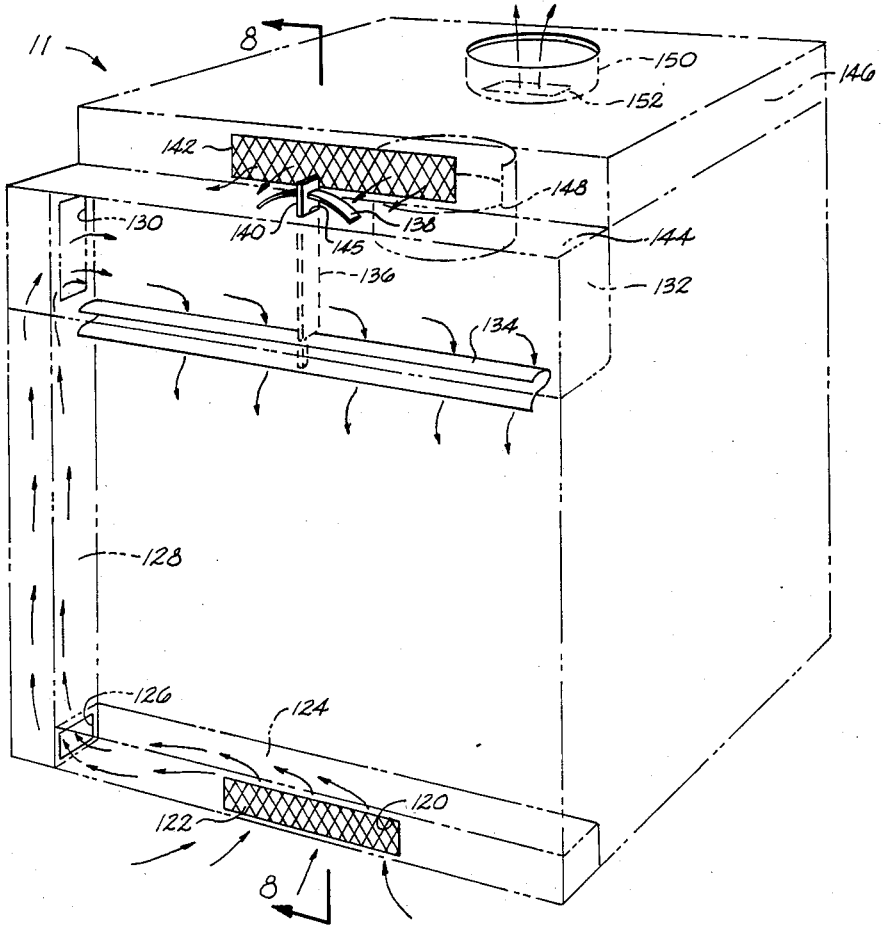
FIG. 7 generally illustrates a perspective view of a wood-burning stove outfitted with another embodiment in accordance with this invention of a combination primary intake air flow control valve and back puff protection check valve.

FIG. 7 illustrates another embodiment of a combined check valve and control valve of the present invention. The stove 11 of FIG. 7 has an intake air flow system similar to the previous embodiments for generally supplying fresh outside air defining a primary air flow into the firebox of stove 11. However, the precise location of the control plates or flaps which both control the flow of air and protect against back puff emissions are located in a relatively different place in the intake air flow path than they were in the previous embodiments.

Generally, intake air enters an intake airflow path through an opening 120 covered by a grillwork 122 located in the lower middle front of stove 10. Opening 120 joins with a lower interior columnar chamber 124 which stretches for most of the horizontal distance across the front of the stove. Of course, the precise location of opening 122 in chamber 124 is not critical, and may be moved to various places along the sides of chamber 124, or may be broken up into a plurality of openings.

A flow of outside air enters chamber 124 through opening 120, and exits chamber 124 through a further opening 126 to enter a side upright columnar chamber 128. Columnar chamber 128 is substantially similar to columnar chambers 50 of FIGS. 3, 4 and 6. A pair of such chambers 128 may be placed in each of the front corner columns of stove 11, but only one such columnar chamber is illustrated in FIG. 7 for purposes of simplicity and clarity. The intake air flow system may be configured in any selected fashion so long as an opening is formed to provide a flow of outside fresh air into an intake air flow path.

At the top of chamber 128 is an opening 130 which leads to an interior chamber 132 formed across the top front of stove 11. This is further illustrated and discussed with reference to FIG. 8. An extended, curved control plate 134 is used to determine the amount of air in chamber 132 which will be permitted to sweep down the front interior portion of a door for stove 11 (illustrated in FIG. 8), and enter the firebox area of stove 11. Arrows in FIG. 7 illustrate how air enters opening 122, flows along chamber 124 through opening 126 and up through upright columnar chamber 128. Upon reaching the top of columnar chamber 128, the intake air flows through opening 130, around the exterior of a curved portion of control plate 134 and underneath a lengthwise end lip of plate 134 so as to enter the firebox of stove 11.

An upright control element 136 is functionally associated with a curved bi-metallic element 138 such that element 138 is held by an upper end 140 of control element 136. Curved bi-metallic element is temperature-responsive to air flowing from an opening covered by grill 142. By cooperating with an upper surface 144 of chamber 132, the flexing of bi-metallic element 138 moves control element 136 upward through an opening 145 in surface 144. The force of gravity acting on the mass of element 136 pushes control plate 134 down whenever bi-metallic element 138 is not flexed upward. Such downward movement of control element 136 is safety-oriented to always close extended control plate 134 if there is a chimney fire or a failure of bi-metallic element 138. In such manner, gravity always closes the intake air as a safety measure, and control plate 134 is safely made temperature responsive so as to variably control the flow of primary intake air into the firebox of stove 11. These control features are established such that control plate 134 simultaneously functions as a check valve to prevent discharge of combustion by-products due to back puff. This back puff protection check valve feature is discussed and more fully explained below in conjunction with FIG. 8.

Because bi-metallic element 138 only performs work while flexing upward, it is not necessary for control element 136 to be a rigid member as illustrated in FIG. 7. It is functionally equivalent for rigid member 136 to be replaced with a non-rigid connecting element, such as bead chain 42 of FIG. 2 since it is a properly positioned mass, and not the downward flexing of 138, which provides the needed force for closing 134.

The air which flows through grillwork 142 and surrounds bi-metallic element 138 is subjected to heating in a heat exchange portion 146 of stove 11. A combustor 148 is included within heat exchange portion 146 so that the air emerging from grillwork 142 may be utilized to heat the room in which the stove is occupied. In other words, the grillwork 142 of FIG. 7 is roughly analgous to the grillwork 16 of FIG. 1 for the purpose of providing a flow of heated air into the room. In the FIG. 7 embodiment, it is such heated air which is monitored with bi-metallic element 138, the temperature-responsive motion of which is used to control the flow of intake air into the firebox of stove 11.

Also illustrated in FIG. 7 is a flue 150 with opening 152 which connects with the chimney portion of a fireplace in a room so as to exhaust combustion gasses.

Figure 8:
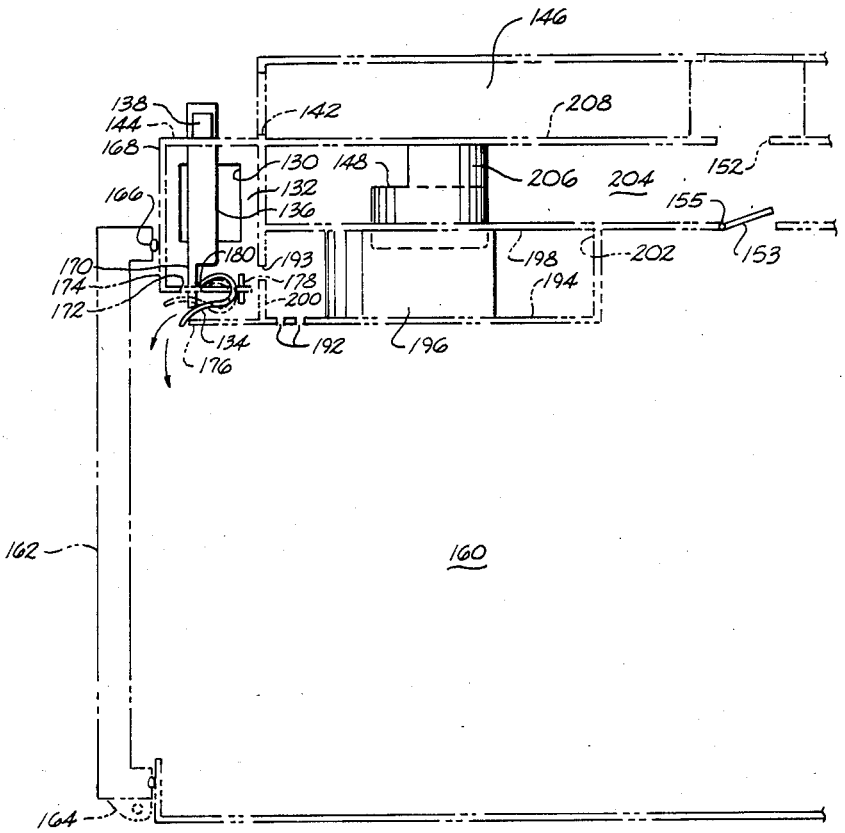
FIG. 8 illustrates one form of a side view of the FIG. 7 embodiment.

Referring now to FIG. 8, a side view of stove 11 of FIG. 7 is illustrated with a firebox area 160 which is closed from the outside across its front portion by a door 162 which is mounted on stove 11 with a hinging means 164. A seal 166 is positioned around the periphery of door 162 so as to seal against the front face 168 of the stove. The top end portion 140 of movable control element 136 is positioned in front of the grillwork opening 142 associated with heat exchange portion 146. The precise operation of combustor 148 will be more fully explained below.

Bi-metallic element 138 rides on top of surface 144 and as captured by upper end element 140 of movable control element 136. As bi-metallic element 138 variably flexes and curls, an end piece 170 of control element 136, which projects through an opening 172 in a supporting L-shaped plate 174, varies the position of control plate 134. The position of control plate 134 in turn controls the flow of air emerging from opening 130 and entering firebox 160. As discussed above, bi-metallic element 138 lifts mass 136 to open 134, but gravity operating on mass 136 closes 134 to constitute a safety-type construction.

The solid line illustration in FIG. 8 of movable control element 136 illustrates the position of bi-metallic element 138 whenever relatively warm air is being passed thereover. In other words, control plate 136 is permitted to move downward by the flexing action of bimetallic element 138 in response to relatively warmer air and is forced downward by gravity acting on the mass of 136 so as to push plate 134 with projecting finger 170 to close against an extended lip 176 defining one upper limit of firebox 160. Such function reduces the flow of fresh intake air into firebox 160 and thereby reduces combustion activity within the firebox. An extended portion of L-shaped shelf 174 has a check member 178 which limits the movement of control plate 134 such that an upper end of the curved control plate 134 is always forced against projecting finger 170 at a point 180. Point 180 thereby defines a pivot point for the control plate 134.

The dotted line representation in FIG. 8 of control plate 134 illustrates its position whenever variable control element 136 is moved upward by bi-metallic element 138 in response to cooler temperatures emerging from opening 142. Such operation permits a desirable increased flow of fresh air from opening 130 into firebox 160 whenever bi-metallic element 138 responds to cooler temperatures emerging from grillwork opening 142.

The solid line and dotted line representations of control plate 134 in FIG. 8 are relative extreme positions. Of course, any position may be assumed in the continuum of positions between these two extremes, all under the control of the temperature-responsive and gravity-guided safety mechanism, discussed above.

Valve 153 has a lightly spring-biased hinge means 155 for connecting firebox chamber 160 directly with upper chamber 204 (i.e., for circumventing combustor 148). Valve 153 is disposed so as to open whenever the pressure within firebox 160 is about 0.5 psi more than in chamber 204, thereby comprising a preset pressure relief valve for the firebox direct to the flue 150 of stove 11. A valve such as 153 may be used with all the embodiments of this invention.

The following is a general description of the air flow in and around combustor 148. A more specific and detailed discussion of such air flow will be provided in conjunction with FIGS. 12 and 13, below. Combustion gasses flow from firebox 160 upwards through a plurality of holes 192 formed in a plate 194 defining one upper wall of firebox 160. Holes 192 are usually only between a shield 196 and forward wall 200, and may preferably number around 56 and be about one-half inch in diameter. Flared out shield 196 extends between plate 194 having holes 192 and a solid upper plate 198. Shield 196 may surround varying portions of combustor 148, but typically covers about 270° around the combustor. Combustion gasses which come up through holes 192 between the shield 196 and front wall 200 swirl towards the back of the stove and outward around shield 196 in a chamber generally defined by elements 194, 198, 200 and a backwall element 202. Holes 193 may be formed in wall 200 to permit fresh air from chamber 132 to mix with the combustion gasses flowing upward through holes 192. Holes 193 preferably are about six in number across the front of wall 200, and may be about one-half inch in diameter. Other sizes, numbers and general placement of holes 192 and 193 are functionally equivalent with those specifically illustrated, and hence fall within the scope of this invention.

The swirling gasses and fresh air flow around shield 196 and up through porous combustor 148 into an upper chamber 204. An upper shield 206 forms a generally semicircular pattern surrounding approximately 225° of combustor 148. Shield or baffle element 206 extends between the upper surface of combustor 148 and an upper solid surface 208. To exit chamber 204 upward through an opening 152 in flue 150, it is necessary for the mixture of combustion gasses and secondary fresh air passing through combustor 148 to swirl towards the front of stove 11, around shield 206 and then backwards towards the rear of stove 11.

The swirling action underneath combustor 148 generated by shield 196 and above combustor 148 generated by shield 206 induces a balanced flow of cumbustion gasses and secondary fresh air across the entire surface of the combustor. This reduces problems of the prior art discussed above in conjunction with uneven function or only partial function of a combustor. Combustor details will be discussed more fully in conjunction with FIGS. 12 and 13, below.

Figure 9:
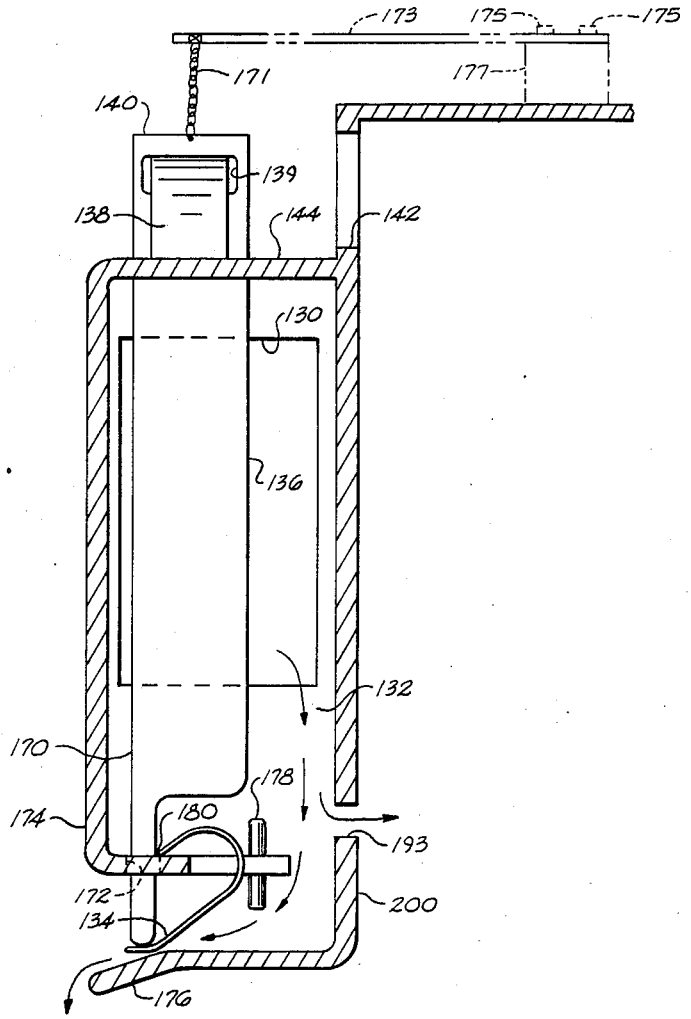
FIG. 9 illustrates an enlarged view of the temperature-responsive control mechanism of FIGS. 7 and 8.

Referring now to FIG. 9, an enlarged illustration shows the temperature-responsive control elements of FIG. 8. Curved bi-metallic element 138 is seated within the upper end portion 140 of movable control element 136, with its respective ends seated on upper surface 144. Slot 139 in end portion 140 is sufficiently large to permit element 138 to flex considerably towards a flattened condition without being distorted when returning to its previous position. Projecting finger portion 170 of movable control element 136 passes through opening 172 which is formed in the L-shaped portion of support bracket 174. A slightly modified version of lip 176 from FIG. 8 is illustrated by FIG. 9. Check member 178 holds movable control plate 134 against finger 170 so as to define a pivot point 180.

As discussed above, fresh air flow comes through opening 130 and passes between lip 176 and control plate 134 as controllably permitted so as to enter firebox 160. Position of controllable plate 134 is established by extended finger 170 of movable control element 136 and check member 178, which in turn is controlled by the response of bi-metallic element 138 to the temperature of the air flow coming through opening 142, and the force of gravity acting on mass 136. The mass of control element 136 biases control plate 134 closed against a chimney draw of about 0.01 to 0.02 inches water column. As bi-metallic element 138 flexes to lift control plate 136 and its projecting finger 170 upward in response to cooler air passing over element 138, the movable control element 134 is permitted to rotate upward and enable an increased flow of fresh air into firebox 160. Alternatively, as warmer air passes over bi-metallic element 138, it flexes to permit projecting finger 170 to move downward under the weight of mass 136 to positively reduce the flow of air through opening 130 into firebox 160 by forcibly reducing the opening between plate 134 and lip 176.

Because there is no firm connection between projecting finger 170 and movable control element 134, and element 134 is always held in a pivotable relation at pivot point 180 by check member 178 and opening 172 with finger 170, movable control valve 134 is also free to operate as a check valve for protection against emissions due to back puff. In other words, as projecting finger 170 raises to permit control valve 134 to pivot for passage of air, any back puff pressure will press on the extended end of control valve 134 and seal it towards lip 176 so as to function as a check valve against emissions by back puff. Therefore, the temperature-responsive control elements of FIGS. 8 and 9 are generic in this sense with the previously described embodiments of this invention in that both control valve features for control of intake air flow and check valve features for protection against back puff are simultaneously achieved with movable control plate 134.

Air holes 193 and associated arrows indicate how fresh air comprising a secondary air flow may flow from chamber 132 into a chamber for mixing with combustion gasses from holes 192 and subsequent passage through combustor 148.

The dotted-line illustrations of FIG. 9 may be substituted for the curved bi-metallic element 138. Bead chain 171 is supported on a bi-metallic arm 173 mounted with screws 175 on base 177, analgous to elements 230 and 232 of FIG. 10, below.

As earlier described, a wood-burning stove generally in accordance with the present invention may have an intake air flow system which includes a lower horizontal columnar chamber for intake of air. Such a lower chamber may join upright columnar chambers, which in turn are associated with an upper horizontal chamber for passing fresh air from outside the stove to the firebox of the stove. In accordance with the present invention, controlling the flow of air in such an intake air flow system, as well as controlling back puff within such an intake air flow system, may be accomplished at any number of different points along the air flow system itself. For example, earlier embodiments of the present invention controlled both intake air flow and back puff at the initial point of the entry of outside air into the intake air flow system. Other previously explained embodiments had a point of control in the air flow system at the last juncture between the air flow system and the firebox.

Figure 10:
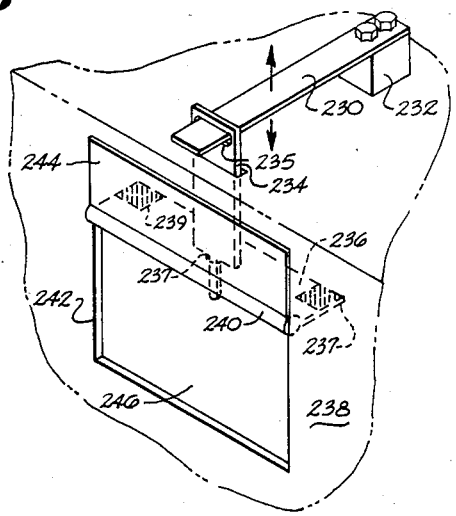

Referring now to FIG. 10, yet another embodiment of the present invention is illustrated wherein a single control mechanism achieves both a control valve function and a check valve function. The embodiment of this invention illustrated by FIG. 10 may be utilized virtually along any point within the intake air flow system. For example, the rectangular flaps illustrated in FIG. 10 may be inserted in an interior opening at the top of an upright columnar chamber which opens into an upper horizontal chamber.

Description of the FIG. 10 embodiment is as follows. A bi-metallic element 230 is fixedly mounted at 232 to some portion of a stove. As understood from the foregoing disclosure, the bi-metallic element 230 flexes upward and downward in response to temperature variations of surrounding air. Temperature-responsive element (bi-metallic element) 230 engages a movable control element 234, through an opening thereof 235, which in turn moves a lever arm board 236 by engagement therewith at an opening 237 therein. Opening 235 is enlarged in the direction of downward flexing of 230, analgous to enlarged opening 139 of FIG. 9. Board 236 is shown in dotted lines located behind a surface wall 238. The control lever arm board 236 is attached to an extended pivoting device (or hinge means) 240 which runs for the length of a rectangular opening 242. Upper and lower flaps 244 and 246 are controlled by the position of board 236 since all three elements are fixedly secured to pivoting device 240. Board 236 is properly sized and weighted with enough mass so as to lightly bias flaps 244 and 246 towards their shutdown positions (i.e., opening 242 closed). Areas 237 and 239 of board 236 are representative of portions which may be notched out or trimmed to effect proper biasing of a given board.

The shape of flaps 244 and 246 may be adapted to fit any given shape of opening 242. For example, opening 242 might be oval in shape, in which case flaps 244 and 246 could have a partial oval shape to accomodate the opening. Of course, circular or some other shapes such as triangular or undefined curves may also constitute shapes of opening 242.

Figure 11:
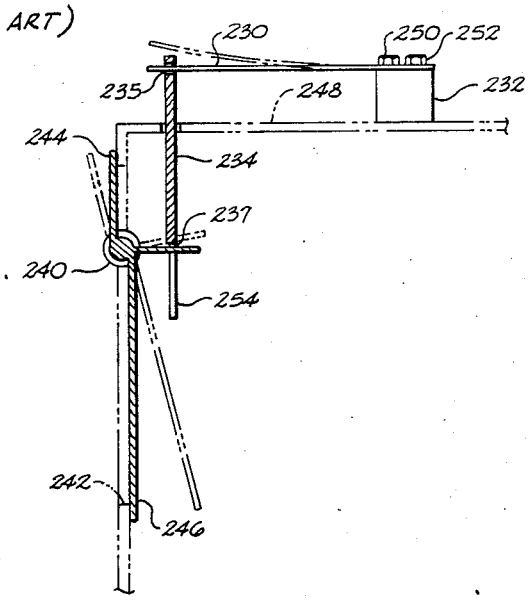
FIGS. 10 and 11 illustrate, respectively, an enlarged perspective and side view of yet another embodiment in accordance with the present invention of a combination control valve and back puff protection check valve for use in an intake air flow.

The temperature-responsive operation of the FIG. 10 embodiment is better understood from the following, taken in conjunction with reference to FIG. 11. Referring now to FIG. 11, support element 232 may be attached to an upper surface 248 of a stove. One end of temperature-responsive bi-metallic element 230 is fixedly secured to fixed element 232 by means of bolts or screws 250 and 252. The other end of element 230 engages movable control element 234 through an opening 235 therein. As with the FIG. 9 embodiment, control element 234 may partially comprise a bead chain or similar item. As illustrated, movable control element 234 has an extended end portion 254 which passes through an opening 237 in lever arm board 236. Furthermore, extended finger element 254 is not fixedly secured to the plate 236. Control element 234 only positively controls the position of plate 236 during downward motion of element 234. Hence, as further explained below, flaps 244 and 246 serve both as control valves for the control of intake air and check valves to protect against emissions due to back puff.

Together, flaps 244 and 246 can fully seal off opening 242. Back puff pressure against the interior side of 246 can cause flap 246 to close against opening 242 and prevent the expulsion of combustion byproducts. Together, the two flaps are slightly biased so as to move towards a closing position in order to prevent slow (i.e., low flow) moving air from coming down the chimney (e.g. during warm weather) and out into the home. Movable control element 234 may be lifted upward by temperature responsive element 230. The degree of biasing used with this embodiment is generally like the other embodiments, i.e., only very slight so as to be readily overcome by chimney draw so as to open the two flaps 246 and 244. A chimney draft of 0.01 to 0.02 inches of water column is generally sufficient to overcome the slight biasing.

The dotted line features of FIG. 11 illustrate a condition wherein cooler air surrounds temperature-responsive element 230. In response to such cooler air, bi-metallic element 230 bends in an upward direction to raise movable control element 234, which in turn permits lever arm board 236 to move upward in response to draw pressure exerted on the firebox. Such movement of lever arm board 236 permits flaps 244 and 246 to be pivoted as shown in dotted line to thereby unblock opening 242. At the same time, because of the larger size of the upper portion of movable element 234 in relation to its extended smaller finger portion 254 and the size of opening 237, flap 246 at all times remains responsive to any back puff pressure so as to be closed by same. Of course, since flap 244 is in fixed relationship with pivoting device 240, as is flap 246, as flap 246 moves to close opening 242 in response to back puff pressure, flap 244 is likewise moved towards its shutdown position for the same purpose.

Figure 12:
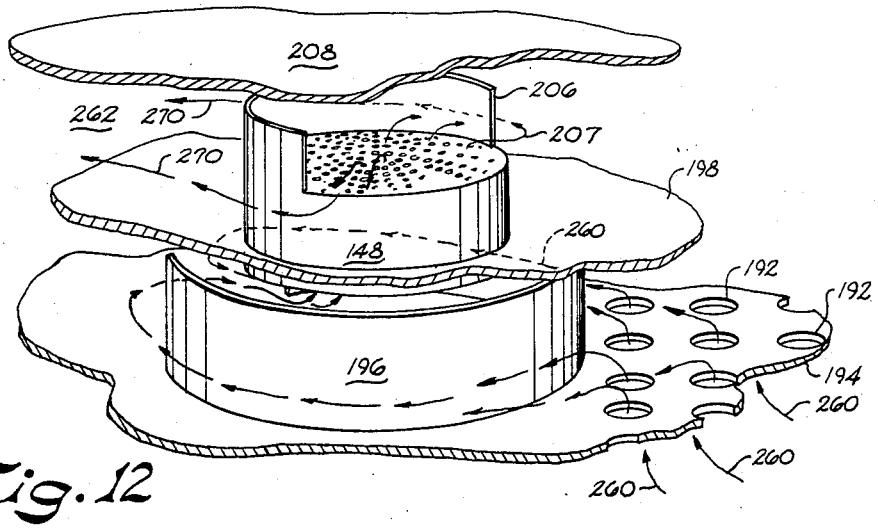
FIGS. 12 and 13 illustrate, respectively, an enlarged perspective and side view of a combustor and fixed-shield baffle flow control means of this invention associated therewith for providing a balanced flow of combustion gasses and secondary fresh air across the entire surface of the combustor.
Figure 13:
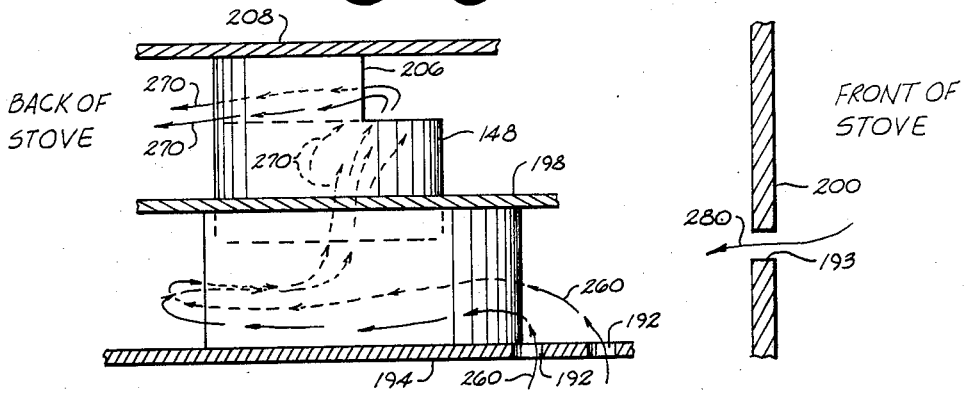

FIGS. 12 and 13 illustrate the fixed-shield baffle means which is associated with combustor 148 for improving the flow of combustion gasses and fresh air across the surface of the combustor and thereby maximize its efficiency. FIG. 12 is a perspective view of combustor 148 turned generally in the reverse direction of FIG. 8. FIG. 12 illustrates that lower plate 194 has a plurality of holes 192 located therein so as to pass combustion gasses upwards from the firebox which is located beneath plate 194. Flared baffle element 196 is fixedly mounted about 270° around combustor 148 with its opening on the side of combustor 148 which is generally closer to the back of the stove, and extends between plates 194 and a solid plate 198 located above it. Combustion gasses which come up through the plurality of holes 192 in plate 194 swirl around baffle 196 in order to gain access to the bottom portion of porous combustor 148. As illustrated in FIGS. 8 and 13, secondary fresh air from holes 193 also mixes with combustion gasses from 192 and swirls around shield 196 and up through combustor 148. The bottom of combustor 148 preferably extends approximately one half of an inch beneath the surface of upper plate 198. Arrows 260 of FIG. 12 generally show in solid and dotted lines how combustion gasses come up through holes 192 and swirl around both sides of shield 196 to get to the bottom of combustor 148.

Located on the side generally closer to the back side of the stove, combustor 148 has a semicircular shield 206 which extends about 225° therearound and from the upper surface of combustor 148 to an uppermost solid plate 208. In order for gasses which pass through porous combustor 148 to exit the wood-burning stove, it is necessary that they swirl around semicircular baffle 206 towards the back of the stove generally in the direction of area 262 of FIG. 12. Such swirl directions flow around both sides of combustor 148 as shown by the solid and dotted lines of arrows 270. Accordingly, such swirling motion generated by the two baffle portions 196 and 206 cause a balanced flow of combustion gasses and secondary fresh air into combustor 148 which provides a more even burn across the combustor, and in turn maximizes efficiency. When assembled in the illustrated fashion, it has been discovered by this inventor that the baffles (i.e., fixed shields) create a proper air path for combustion gasses augmented by secondary fresh air through the combustor to achieve a balanced flow across the entire surface of the combustor, thereby greatly reducing the uneven and spotty burning generally associated with prior art combustor systems for wood-burning stoves. During steady state operation, the temperature across the surface of the combustor does not vary more than 50° Centigrade.

FIG. 13 avails a side view of the FIG. 12 illustration. Combustor 148 is generally located above solid plate 198, but approximately half of an inch thereof rides beneath the surface of solid plate 198, as discussed above. The flared out shielding 196 which is located generally on the front side of the stove extends around combustor 148 for about 270° between plate 194, having holes 192, and solid plate 198. As in FIG. 12, combustion gasses from holes 192 and fresh air 280 from holes 193 in wall 200 flow upward through plate 194 and swirl around both sides of shielding 196 towards the left of FIG. 13 (i.e., back side of stove) as necessary so as to get to and enter porous combustor 148. As again illustrated by the solid and dotted lines of arrows 260 and 280, gasses and fresh air which have been so swirled flow evenly through combustor 148 and exit its top portion. The solid and dotted lines of arrows 270 then show how the exiting combustion gasses swirl towards the back of the stove around both sides of shield 206, which shield extends from the upper surface of combustor 148 in semicircular fashion for about 220° to the bottom of upper solid plate 208. The two swirling actions caused by the lower shield 196 and upper shield 206 contribute to the improved burning action achieved for the combustor in accordance with the present invention.

While the foregoing has disclosed and described specific embodiments which may be practiced in accordance with the present invention, all such embodiments are intended as exemplary only, and are not intended to limit the present invention. Also, it is not intended that the drawings illustrated in this application be interpreted as drawn precisely to scale. Any and all modifications, variations and obvious substitutions relative to the above embodiments and general teachings of this invention which would occur to one of ordinary skill in the art are included within the broader scope of this invention. For example, any interchanging of features among the various embodiments illustrated falls within the scope of this invention. Only the appended claims provide further definition or limitation to this invention, but those also are intended to cover all equivalents and the foregoing alluded-to modifications.

What I claim is:

1. An apparatus for burning fuel to provide heat, comprising:

a housing defining a firebox within said housing for said burning;

at least one intake air pathway joining the exterior of said housing with said firebox;

at least one exhaust pathway joining said firebox with the exterior of said housing;

a controllable member associated with said intake pathway and controllably movable for alternately closing and opening such pathway; and control means, operatively associated with said controllable member, for controlling the air flow within said intake pathway in response to a first temperature condition of said burning within said housing, and for closing said intake pathway in response to a second condition of excess of pressure within said housing.

2. An apparatus as in claim 1, wherein:

said first condition comprises a temperature related to said burning within said firebox; and said control means responds to relative increases in said temperature to reduce air flow in said intake pathway, and responds to relative decreases in said temperature to permit increase of said air flow in said intake pathway.

3. An apparatus as in claim 2, wherein:

said second condition comprises the presence of back puff pressure within said housing; and said control means responds to said back puff pressure to close said intake pathway and thereby prevent emissions due to said back puff pressure.

4. An apparatus as in claim 3, wherein said control means comprises:

a pair of bi-metallic rods; and a pair of elements, one each respectively associated with one of said rods, for responding to physical displacement of said rods to reduce gas flow through said intake pathway with increases in temperature, and to permit increases in gas flow through said intake pathway with decreases in temperature.

5. An apparatus as in claim 3, wherein said control means comprises:

a temperature-responsive element;

a control element which is operative to actuate control of said controllable member; and a connecting element for connecting said temperature-responsive and control elements, wherein said temperature-responsive element flexes during warmer temperatures so as to permit said control element under the force of gravity to move said controllable member in a direction for closing said intake pathway, and flexes during cooler temperatures so as to permit said controllable member to be opened in response to draw pressure exerted on said firebox.

6. An apparatus as in claim 3, wherein said control means comprises:

a temperature-responsive element; and pivotal means, response to said temperature-responsive element, for permitting movement of said controllable member towards closing said intake pathway, under the force of gravity acting on said pivotal means, with relative increases in temperature, and for permitting movement of said controllable member away from closing said intake pathway in accordance with draw acting on said firebox during relative decreases in temperature.

7. An apparatus as in claim 6, wherein said control means further comprises a free-hanging pendulum arm, hanging inside said intake pathway and with said controllable member integrally formed on the lower end thereof.

8. An apparatus as in claim 7 wherein said pendulum arm is slightly biased in the direction of closing said intake pathway.

9. An apparatus as in claim 6, wherein:

said temperature-responsive element comprises a bi-metallic member; and said pivotal means comprises a pair of generally L-shaped members which receive said bi-metallic member on one end thereof and interact with said controllable member on the other ends thereof.

10. An apparatus as in claim 9, wherein said bi-metallic member has a registration means for establishing a maximum pivoted position of said pivotal means in the direction of closing said intake pathway, and for retaining said bi-metallic member in proper relationship with said pivotal means.

11. An apparatus as in claim 6, wherein said controllable member is slightly biased in a direction of closing said intake pathway, which bias may be overcome by a predetermined amount of draw pressure exerted on said firebox.

12. An apparatus as in claim 1, wherein:

said second condition comprises an occurrence of back puff pressure within said housing; and said control means responds to an occurrence of back puff to reduce air flow within said intake pathway regardless of the state of said first condition.

13. An apparatus as in claim 1, wherein said intake pathway comprises an interior pathway beginning generally at the bottom front of said housing, rising along the sides of said housing and terminating with a horizontal chamber across the top front of said housing, which horizontal chamber adjoins an entrance to said firebox.

14. An apparatus as in claim 13, wherein said control means is operative on said intake pathway near the beginning of said interior pathway.

15. An apparatus as in claim 13, wherein said control means is operative on said intake pathway near a juncture between said rising portion of said interior pathway and an entrance to said horizontal chamber.

16. An apparatus as in claim 13, wherein said control means is generally operative on said intake pathway in a juncture between said horizontal chamber and said entrance to said firebox.

17. An apparatus as in claim 16, further including:

an internal member for pivotally supporting said controllable member; and a registration element for maintaining said controllable member in predetermined relationship with said internal member and with said control means so as to define a pivot point for said controllable member.

18. An apparatus as in claim 1, wherein said control means further functions to close said intake pathway in response to either of a failure of other portions of said control means and an occurrence of uncontrollable burning associated with said apparatus.

19. An apparatus for burning fuel to provide heat, comprising:

a housing defining a firebox wihtin said housing for said burning;

at least one intake air pathway joining the exterior of said housing with said firebox;

at least one exhaust pathway joining said firebox with the exterior of said housing; and control means, operatively associated with said intake pathway, for controlling the air flow within said intake pathway in response to a first condition of said burning within said housing, and for closing said intake pathway in response to a second condition of excess pressure within said housing; wherein said exhaust pathway includes a flue adapted for association with a chimney with which said apparatus is operably associated; and said apparatus further includes a preset pressure relief valve for automatically permitting a flow of gasses from said firebox into said flue wherever the pressure in said firebox exceeds that in said flue by a predetermined amount.

20. An apparatus for burning of combustible materials, comprising:

(a) a housing, said housing defining a firebox therewithin for combustion of said combustible products, at least one opening for ingress of primary air into said firebox and an opening for exit of combustion gasses from said firebox;

(b) means associated with said housing for controlling ingress of primary air into said firebox at each said ingress opening responsive to heat generated in said firebox, said control means being gravity biased toward closing said at least one opening and having thermally-responsive means associated therewith for overcoming said gravity bias whereby said draft created across said firebox will permit ingress of primary air through said at least one ingress opening and whereby said control means will respond to excess pressure generated within said firebox to close said at least one ingress opening.

21. A stove as in claim 20, wherein said control means further functions to close said at least one ingress opening under the force of gravity if other portions of said control means has a mechanical failure or if said heat exceeds a predetermined temperature.

22. A stove having a combustor, comprising:

a firebox for burning fuel to produce heat and combustion gasses;

an intake air pathway for providing primary air flow to said firebox and secondary air flow to said combustor; and means associated with said combustor for providing a balanced flow of a mixture of said combustion gasses and said secondary air flow across the surface of said combustor; wherein said stove further comprises an exhaust pathway connectable with a chimney associated therewith; and wherein said means comprises:

a lower chamber, receiving in one portion thereof said secondary air flow from said intake pathway and a flow of combustion gasses form said firebox region, and an upper chamber adjacent said lower chamber, and which connects with said exhaust pathway; and wherein said combustor is lodged in an opening defined by a mutual wall of said lower and upper chambers such that said combustor partly resides in each of said chambers, and said combustor completely fills such opening so that combustion gases and secondary air flow throughout the entirety of said combustor from said lower chamber to said upper chamber.

23. A stove as in claim 22, wherein said means further comprises a first curved surface, extending from the top to the bottom within said lower chamber, defining a first shroud around said combustor partly residing in said lower chamber and having an opening away from said one portion so that said combustion gasses and secondary air flow are accelerated and swirled around the curved surfaces of said first shroud as they enter said first shroud opening to rise through said combustor and ignite same.

24. A stove as in claim 23, wherein said means further comprises a second curved surface, extending from the top of said combustor within said upper chamber to the top of said upper chamber, defining a second shroud around the air space between said combustor and the top of said upper chamber and having an opening opposite from said first shroud opening so that the flow of combustion gasses are biased so as to be even through all cells of said combustor.

25. A stove, comprising:

a firebox for burning fuel placed therein and producing heat and combustion gasses;

an intake air opening providing primary air to said firebox and providing a source of secondary air;

a controllable member disposed relative said intake air opening;

means for controllably limiting the amount of primary air provided through said intake air opening to said firebox in response to the temperature therein;

means for sealing said intake air opening in response to the presence of back puff conditions in said firebox, to prevent emissions of said conbustion gasses from said intake opening;

a combustor;

means for evenly supplying a mixture of said secondary air and combustion gasses from said firebox for passage throughout substantially most of said combustor, thereby resulting in relatively even steady-state operation of said combustor.

26. A stove as in claim 25 wherein, during said steady-state operation of said combustor, the surface temperature thereof does not vary more than 50° Centigrade.

* * * * *